US009633530B2

(12) United States Patent
Chen et al.

(10) Patent No.: US 9,633,530 B2
(45) Date of Patent: Apr. 25, 2017

(54) DOORBELL DEVICE

(71) Applicant: Sercomm Corporation, Taipei (TW)

(72) Inventors: Chien-Ming Chen, Taipei (TW); Meng-Chien Chiang, Taipei (TW)

(73) Assignee: SERCOMM CORPORATION, Taipei (TW)

( * ) Notice: Subject to any disclaimer, the term of this patent is extended or adjusted under 35 U.S.C. 154(b) by 121 days.

(21) Appl. No.: 14/714,474

(22) Filed: May 18, 2015

(65) Prior Publication Data

US 2015/0339895 A1 Nov. 26, 2015

Related U.S. Application Data

(60) Provisional application No. 62/002,197, filed on May 23, 2014.

(30) Foreign Application Priority Data

Mar. 4, 2015 (CN) ..... 2015 2 0125804 U

(51) Int. Cl.

| | |
|---|---|
| ***G08B 3/00*** | (2006.01) |
| ***G08B 3/10*** | (2006.01) |
| ***G10K 1/064*** | (2006.01) |

(52) U.S. Cl.

CPC ..... *G08B 3/10* (2013.01); *G10K 1/064* (2013.01)

(58) Field of Classification Search

CPC ..... H04L 1/00; G08B 1/00

See application file for complete search history.

(56) References Cited

U.S. PATENT DOCUMENTS

| | | | | |
|---|---|---|---|---|
| 2004/0164872 | A1* | 8/2004 | Chiu | G08B 3/10 340/692 |
| 2011/0090068 | A1* | 4/2011 | Langer | G08B 3/10 340/333 |
| 2014/0070922 | A1* | 3/2014 | Davis | G08B 3/1016 340/6.1 |
| 2015/0198958 | A1* | 7/2015 | Galinski, III | H02M 3/1582 323/271 |

* cited by examiner

*Primary Examiner* — Shirley Lu

(74) *Attorney, Agent, or Firm* — McClure, Qualey & Rodack, LLP

(57) ABSTRACT

A doorbell device is provided. The doorbell device includes a user interface, a control circuit, a power switching circuit, a first capacitor, a second capacitor, and a charge/discharge control circuit. The user interface includes a button. The control circuit is coupled to the user interface and generates a power control signal according to a state of the button. The power switching circuit is coupled to the control circuit and outputs a first voltage signal at a first node to supply power to the control circuit according to the power control signal. The first capacitor is coupled to the first node. The charge/discharge control circuit is coupled between the first node and the second capacitor and controls whether the second capacitor is charged or discharged according to the first voltage signal.

14 Claims, 6 Drawing Sheets

DOORBELL DEVICE

This application claims the benefits of U.S. provisional application Ser. No. 62/002,197, filed May 23, 2014, and People's Republic of China application Serial No. 201520125804.4, filed Mar. 4, 2015, the subject matters of which are incorporated herein by reference.

BACKGROUND

Field of the Invention

The disclosure relates in general to a doorbell device, and more particularly to a doorbell device triggered by pressing a button.

Related Art

Doorbell has been widely used in most families at the door entrance. When a visitor arrives or when a resident comes back home, the doorbell may be pressed to generate sound to inform a person in the building. There is a need for designing a versatile doorbell device with multiple functions, while considering cost reduction and ease of installation at the same time.

SUMMARY

The disclosure is directed to a doorbell device.

According to one embodiment of the invention, a doorbell device is provided. The doorbell device includes a user interface, a control circuit, a power switching circuit, a first capacitor, a second capacitor, and a charge/discharge control circuit. The user interface includes a button. The control circuit is coupled to the user interface and generates a power control signal according to a state of the button. The power switching circuit is coupled to the control circuit and outputs a first voltage signal at a first node to supply power to the control circuit according to the power control signal. The first capacitor is coupled to the first node. The charge/discharge control circuit is coupled between the first node and the second capacitor and controls whether the second capacitor is charged or discharged according to the first voltage signal.

According to another embodiment of the invention, a doorbell device is provided. The doorbell device includes a user interface, a control circuit, a power switching circuit, a first buck converter, a first capacitor, a second capacitor, and a charge/discharge control circuit. The user interface includes a button. The control circuit is coupled to the user interface and generates a power control signal according to a state of the button. The power switching circuit is coupled to the control circuit and outputs a first voltage signal at a first node according to the power control signal. The first buck converter is coupled between the first node and the control circuit, converting the first voltage signal down to a second voltage signal to supply power to the control circuit. The first capacitor is coupled to the first node. The charge/discharge control circuit is coupled between the first node and the second capacitor and controls whether the second capacitor is charged or discharged according to the first voltage signal.

The invention will become apparent from the following detailed description of the preferred but non-limiting embodiments. The following description is made with reference to the accompanying drawings.

Figure 1:
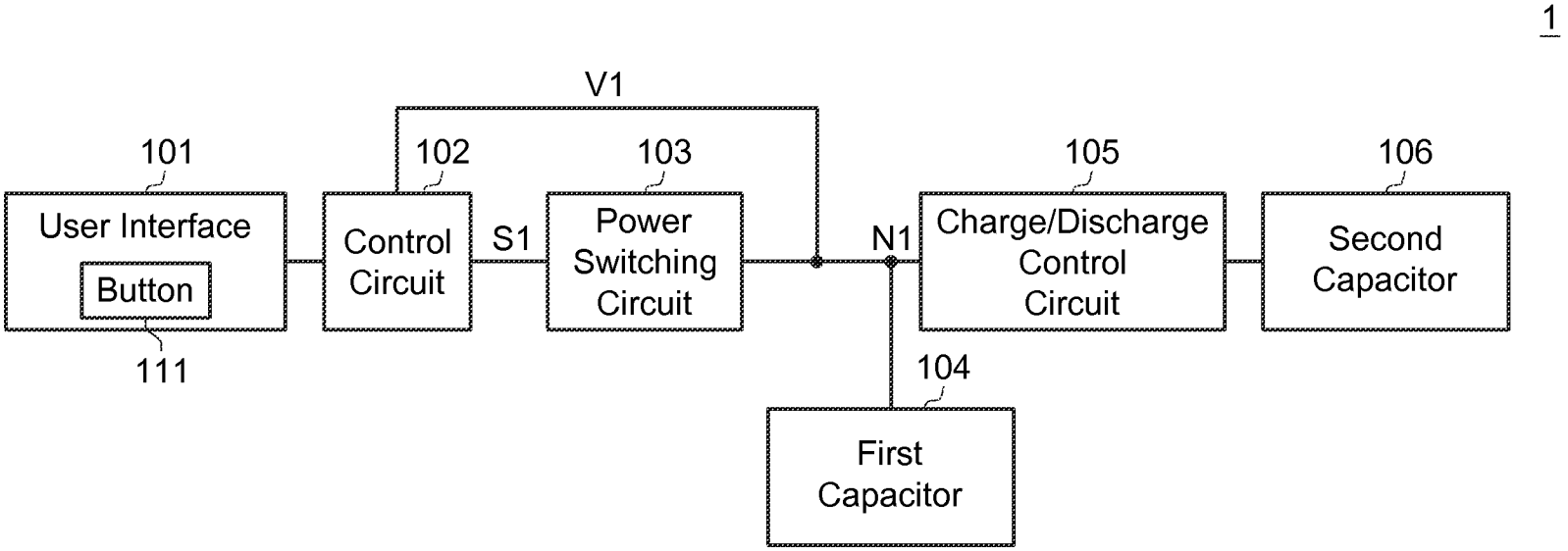
FIG. 1 shows a diagram of a doorbell device according to the first embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

An exemplary driving method of a doorbell driven by electrical signals is described as follows: A chime device is installed inside a building. The chime device may include a solenoid, which consists of a wire coil surrounding a plunger. When the doorbell is not pressed, current is supplied to the control circuit within the doorbell device in order to make the control circuit function properly. The solenoid is kept in a stable neutral position at this time. When the doorbell is pressed, a current loop is formed by a power switching circuit and the solenoid such that the current flows through the metal coil. Because of the induced magnetic field, the solenoid leaves the neutral position and strikes a bell, producing a sound to inform a user that the doorbell is pressed.

When the doorbell is pressed, power originally supplied to the interior of the doorbell device is switched to be supplied to the chime device located indoors, which makes the circuitry inside the doorbell device lose power temporarily. Therefore a Li-ion battery is usually installed in a doorbell. However, batteries occupy a large portion of space in the doorbell. Moreover, batteries eventually run out of power. Even if rechargeable batteries are adopted, additional charging circuit is required in the doorbell device. Furthermore, boost converters are required to increase the voltage generated by batteries in order to provide sufficient voltage to drive other circuit blocks in the doorbell device. Additional circuit blocks as mentioned above and the battery itself occupy a significant amount of space, resulting in an increased production cost.

FIG. 1 shows a diagram of a doorbell device 1 according to the first embodiment of the invention. The doorbell device 1 includes a user interface 101, a control circuit 102 (the control circuit 102 may include a microprocessor, WiFi chipsets, driving circuitry for IP camera, microphone, speaker, etc.), a power switching circuit 103, a first capacitor 104, a second capacitor 106, and a charge/discharge control circuit 105. The user interface 101 includes a button 111. The button 111 may be a physical hardware button or a virtual software button displayed on a screen. The control circuit 102 is coupled to the user interface and generates a power control signal S1 according to a state of the button 111. The power switching circuit 103 is coupled to the control circuit 102 and outputs a first voltage signal V1 at a first node N1 to supply power to the control circuit 102 according to the power control signal S1. The first capacitor 104 is coupled to the first node N1. The charge/discharge control circuit 105 is coupled between the first node N1 and the second capacitor 106 and controls whether the second capacitor 106 is charged or discharged according to the first voltage signal V1.

The control circuit 102 generates the control signal S1 to control the power switching circuit 103 according to the state of the button 111. While in a normal state, the button 111 is not pressed, the control signal S1 may be a signal with low logic level, such that the first voltage signal V1 at the first node V1 generated by the power switching circuit 103 is at a normal supply level. For convenience of description, the normal supply level of the first voltage signal V1 is set as 12V in the examples in this disclosure. While the invention is not limited thereto, the actual supply voltage level may vary depending on the real circuit implementation. At this time (when the button 111 is not pressed), current does not flow through the chime device located indoors, and thus no sound is produced.

When the button 111 is pressed, the control signal S1 may be a signal with high logic level, such that the power is switched to be supplied to the chime device. Thus the first voltage signal V1 at the first node N1 generated by the power switching circuit 103 is lower than the normal supply level 12V. At this time (when the button 111 is pressed), because the supply power is switched to the chime device, current flows through the solenoid inside the chime device to strike a bell to produce sound.

The charge/discharge control circuit 105 is coupled between the first capacitor 104 and the second capacitor 106. The charge/discharge control circuit 105 controls whether the second capacitor 106 is charged or discharged according to the first voltage signal V1. When the button 111 is pressed such that the first voltage signal V1 is lower than the normal supply voltage 12V, the first voltage signal V1 can be maintained in an allowable supply voltage range. The allowable supply voltage range may be 10V~12V. One embodiment of the charge/discharge control circuit 105 is given below.

The charge/discharge control circuit 105 monitors the first voltage signal V1. In this example, the objective is to maintain voltage level of the first voltage signal V1 close to 12V. When the first voltage signal V1 is greater than or equal to a threshold voltage Vth, such as 10V, the charge/discharge control circuit 105 controls the second capacitor 106 to be charged to a predetermined voltage level Vp, such as 23V. The second capacitor 106 may be a capacitor with large capacitance value, such as multiple capacitors connected in parallel. A large amount of charge is stored in the second capacitor 106 because of the high voltage level and the large capacitance. The charge/discharge control circuit 105 may be a dying gasp control circuit used in xDSL application.

When the first voltage signal V1 is less than the threshold voltage Vth, for example, when the button 111 is pressed such that power switching occurs, the power supplied to the circuitry inside the doorbell device 1 can be provided by the second capacitor 106 because of the large amount of charge stored there. The charge/discharge control circuit 105 controls the second capacitor 106 to be discharged to maintain the first voltage signal V1 within an allowable supply voltage range to supply power to the control circuit 102.

Figure 2A:
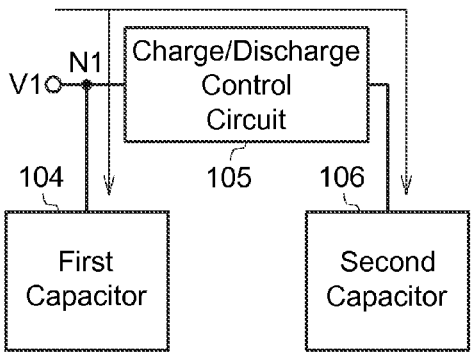
FIG. 2A shows the direction of the current charging the first and second capacitors.
Figure 2B:
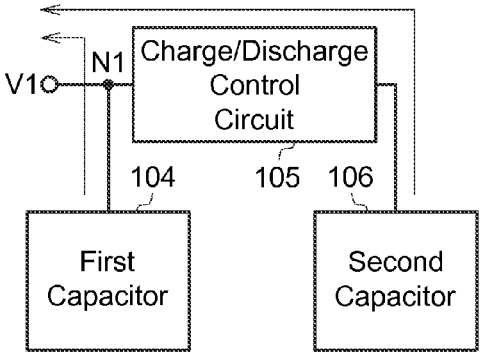
FIG. 2B shows the direction of the current discharging the first and second capacitors.

FIG. 2A shows the direction of the current charging the second capacitor 106. The current from the power switching circuit 103 is provided to the first capacitor 104 and the second capacitor 106, such that the first voltage signal is 12V, and the second capacitor 106 is charged to a predetermined voltage level Vp, such as 23V. FIG. 2B shows the direction of the current discharging the second capacitor 106. The power switching circuit 103 no longer provides current to the control circuit 102. Instead the second capacitor 106 and the first capacitor 104 are discharged to provide current, such that the first voltage signal V1 is maintained in an allowable supply voltage range.

According to the doorbell device 1 as described above, because the second capacitor 106 stores sufficient charge in the normal condition, when the power switching happens (for example, when the button 111 is pressed), the second capacitor 106 can be discharged to provide current in order to supply power to the control circuit 102 within a finite time duration, such that the doorbell device 1 keeps functioning properly.

Figure 3A:
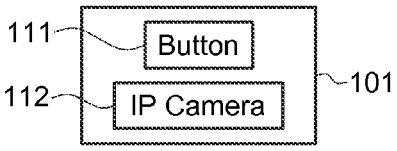
FIG. 3A shows a diagram of the user interface according to the second embodiment of the invention.

FIG. 3A shows a diagram of the user interface 101 according to the second embodiment of the invention. In this embodiment, the user interface 101 further includes an IP camera 112. The IP camera 112 may record digital videos, and may be used for home securities. The IP camera 112 is capable of transmitting and receiving data via network, and hence is easy to use and setup.

Figure 3B:
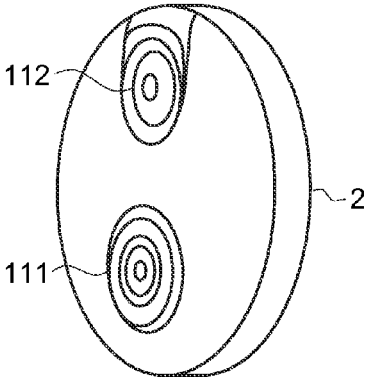
FIG. 3B shows an appearance of the doorbell device according to the second embodiment of the invention.

FIG. 3B shows an appearance of the doorbell device 2 according to the second embodiment of the invention. A camera lens is disposed on the doorbell device 2. The doorbell device 2 acts as not only a doorbell but also a security monitoring device. In addition to the button 111 and the IP camera 112, the doorbell device 2 may further include a microphone and a speaker. Thus the home owner can see the image of a visitor and also talk with the visitor. The control circuit 102 in this embodiment is responsible for not only generating the power control signal S1 but also controlling related activities of the IP camera 112, including video processing and network data transmission. The control circuit 102 may include a microprocessor. Since the control circuit 102 takes charge of operation of the IP camera 112, it becomes even more important to keep the power being continuously supplied to the control circuit 102 when the button 111 is pressed, such that the IP camera 112 can still function properly to capture videos uninterruptedly and encode video data when the button 111 is pressed.

Figure 4:
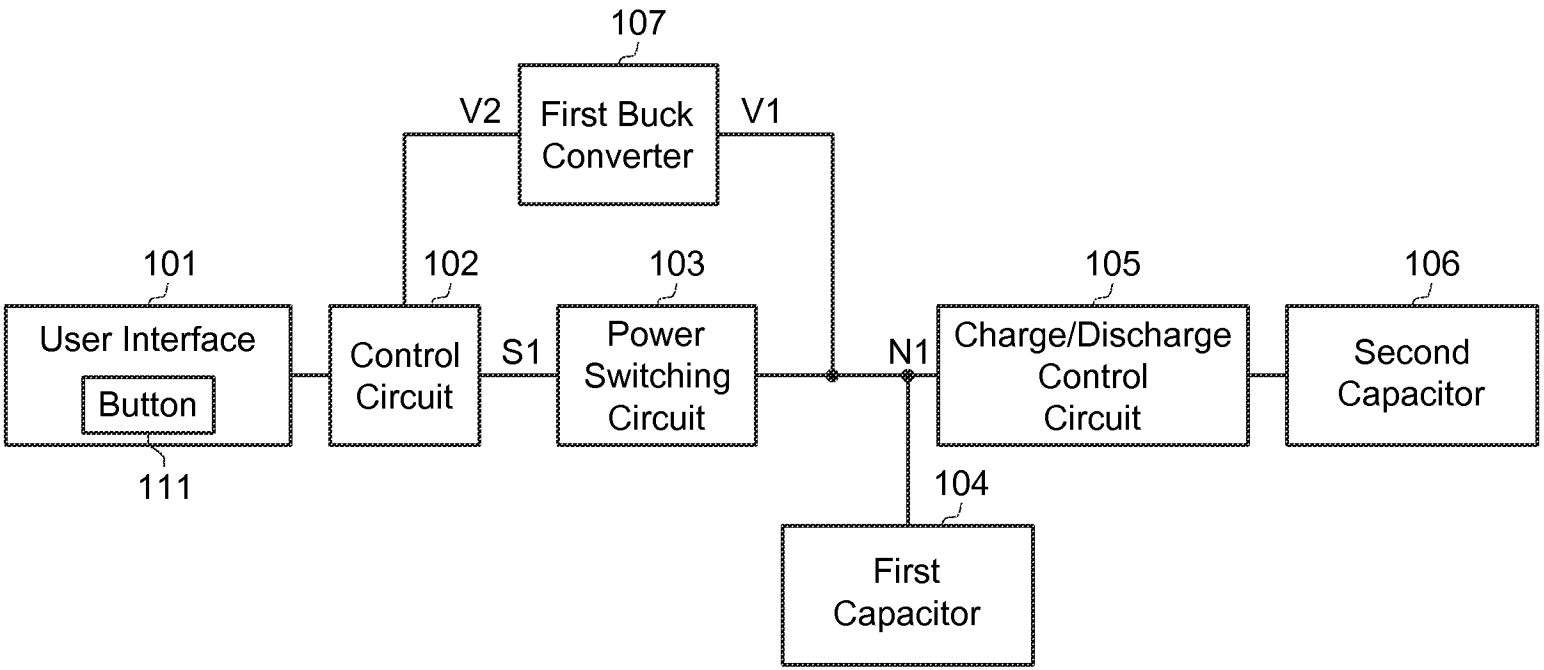
FIG. 4 shows a diagram of a doorbell device according to the third embodiment of the invention.

FIG. 4 shows a diagram of a doorbell device 3 according to the third embodiment of the invention. The difference between the doorbell device 3 and the doorbell device 1 in the first embodiment is that the doorbell device 3 further includes a first buck converter 107 coupled between the first node N1 and the control circuit 102. The first buck converter 107 converts the first voltage signal V1 down to a second voltage signal V2 to supply power to the control circuit 102.

When the first voltage signal V1 is within a specific range, the second voltage signal V2 generated by the first buck converter 107 is a steady voltage level. For example, when the first voltage signal V1 is in the range of 8V-30V, the second voltage signal V2 generated is steady 5V. Hence the power supplied to the control circuit 102 can be maintained in a steady voltage level. The voltage level of the second voltage signal V2 generated by the first buck converter 107 is determined according to the physical design of the control circuit 102, such as depending on the manufacturing process adopted. The second voltage signal V2 may be a supply voltage of 5V, 3V, 1.8V. Furthermore, the first buck converter 107 may include multiple stages of buck converters. For example, the first buck converter 107 may include two stages. The first stage of buck converter converts 12V down to 5V, and then the second stage of buck converter coverts 5V down to 3.3V.

Figure 5A:
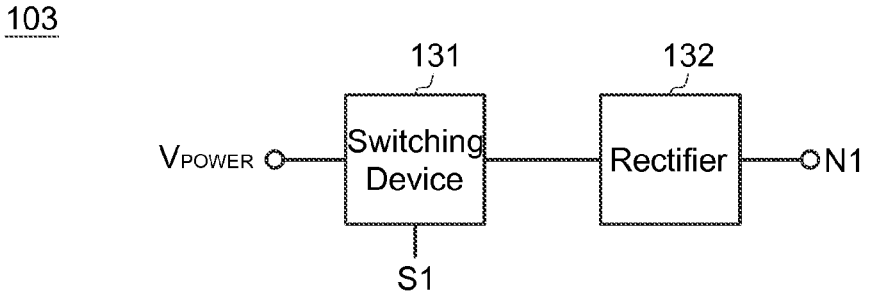
FIGS. 5A-5B show diagrams of multiple implementations of the power switching circuit.
Figure 5B:
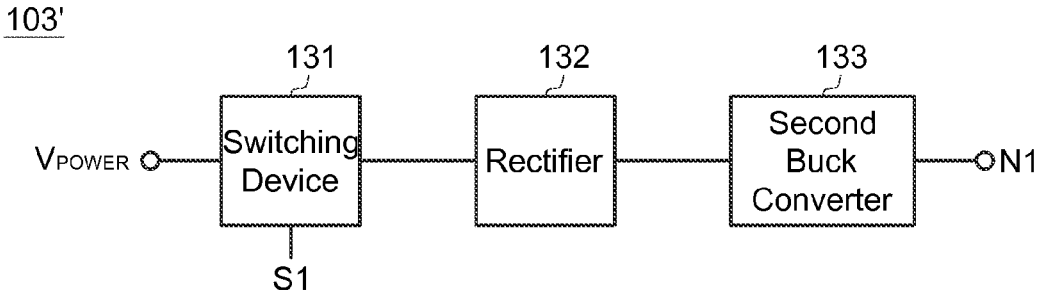

FIGS. 5A-5B show diagrams of multiple implementations of the power switching circuit 103. As shown in FIG. 5A, the power switching circuit 103 includes a switching device 131 and a rectifier 132. The switching device 131 receives a power supply signal $V_{POWER}$ via an input terminal and receives the power control signal S1 via a control terminal. The power supply signal $V_{POWER}$ may be an AC power source directly from mains electricity, such as AC 120V. The power supply signal $V_{POWER}$ may also be a low voltage AC power source generated by a transformer, such as AC 24V. The power supply signal $V_{POWER}$ is the power source of the doorbell device 3.

The switching device 131 may be a relay, which can change the current direction in response to a control signal. The rectifier 132 converts the AC power into a DC power. The switching device 131 is controlled by the power control signal S1. When the button 111 is not pressed, the switching device 131 controls the power supply signal $V_{POWER}$ to pass through the rectifier 132 to be transmitted to the first node N1, supplying power to the circuit in the doorbell device 3. When the button 111 is pressed, the switching device 131 controls the power supply signal $V_{POWER}$ to stop being transmitted to the first node N1. For example, the power supply signal $V_{POWER}$ is switched to be transmitted the chime device in order to produce sound.

The power control signal S1 may be generated according to the time duration of pressing the button 111. For example, the power control signal S1 may be kept in logic high level when the button 111 is being pressed. Alternatively, the power control signal S1 may also be a pulse signal. For example, when the button 111 is pressed, the power control signal S1 changes from logic low level to logic high level for a short period of time, and then changes back to logic low level. By generating the power control signal S1 in a pulse form, the time duration that the supply power of the internal circuit of the doorbell device 3 is provided by the second capacitor 106 can be controlled within a preset range. Therefore even if the button 111 is pressed for too long, the stored energy in the second capacitor 106 will not be depleted.

The power supply signal $V_{POWER}$ is an AC power. The power switching circuit 103 includes a rectifier 132, such as a bridge rectifier. The rectifier 132 converts the input AC power, such as AC 24V, to an output DC power, such as DC 34V.

As shown in FIG. 5B, the power switching circuit 103' may further include a second buck converter 133. The second buck converter 133 is coupled between the rectifier 132 and the first node N1. The second buck converter 133 converts voltage outputted from the rectifier 132 (such as DC 34V) down to the first voltage signal V1 at the first node N1 (such as DC 12V). When the voltage outputted from the rectifier 132 is in a specific range, for example, larger than 25V, the first voltage signal V1 outputted from the second buck converter 133 is steady 12V.

Figure 6:
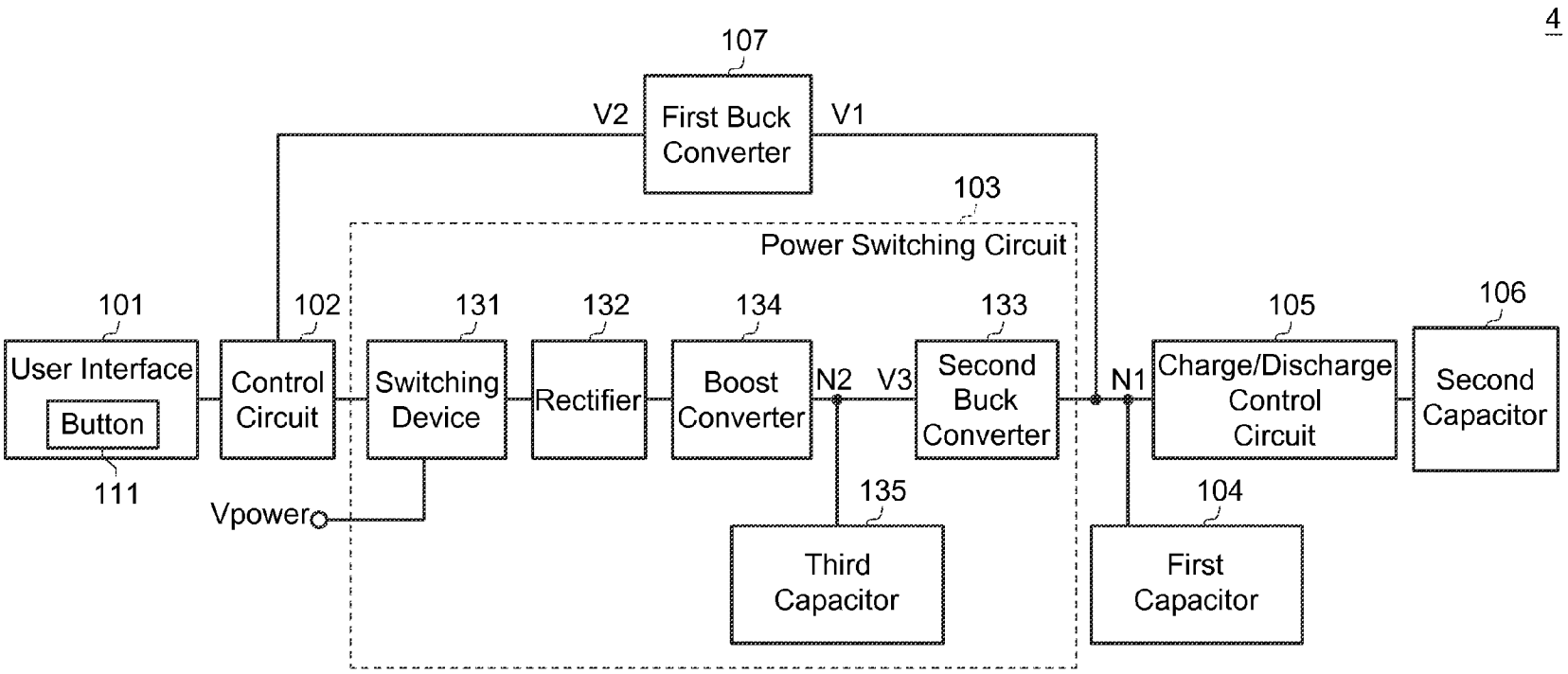
FIG. 6 shows a diagram of a doorbell device according to the fourth embodiment of the invention.

FIG. 6 shows a diagram of a doorbell device 4 according to the fourth embodiment of the invention. As compared to the third embodiment, the power switching circuit 103 further includes a switching device 131, a rectifier 132, a boost converter 134, a third capacitor 135, and a second buck converter 133. The switching device 131 receives the power supply signal VPOWER. The boost converter 134 converts the voltage outputted from the rectifier (such as DC 34V) up to a third voltage signal V3 (such as DC 70V) at a second node N2. The third capacitor 135 is coupled to the second node N2. The second buck converter 133 is coupled between the second node N2 and the first node N1, converting the third voltage signal V3 down to the first voltage signal V1 (such as DC 12V).

Regarding the doorbell device 4 shown in FIG. 6, the first buck converter 107 is optional. The connection relationship between circuit blocks may be similar to that of the doorbell device 1 shown in FIG. 1. That is, the first node N1 may be directly coupled to the control circuit 102 to supply power to the control circuit 102. Alternatively the circuit blocks may be arranged similarly to the doorbell device 3 shown in FIG. 4. The first buck converter 107 is coupled between the first node N1 and the control circuit 102, converting the first voltage signal V1 down to the second voltage signal V2 to supply power to the control circuit 102.

It should be noted that the doorbell device 4 in this embodiment includes the third capacitor 135. When the button 111 is not pressed, the power supply signal $V_{POWER}$ is transmitted to the second node N2 and the first node N1. The boost converter 134 provides current to charge the third capacitor 135. In addition, the first capacitor 104 and the second capacitor 106 are charged as well, as described in the previous embodiments.

When the button 111 is pressed, the power supply signal $V_{POWER}$ is not transmitted to the second node N2. The third voltage signal V3 outputted from the boost converter 134 begins decreasing. The third capacitor 135 is discharged through the second buck converter 133 to maintain the voltage level of the first voltage signal V1. By discharging the third capacitor 135, the first voltage signal V1 at the output of the second buck converter 133 can be kept at 12V. If the time duration of power switching lasts longer, the charge stored in the third capacitor 135 may not be sufficient to keep the first voltage signal V1 at 12V. Then the second capacitor 106 is discharged to maintain the first voltage signal V1 in the allowable supply voltage range.

Figure 7A:
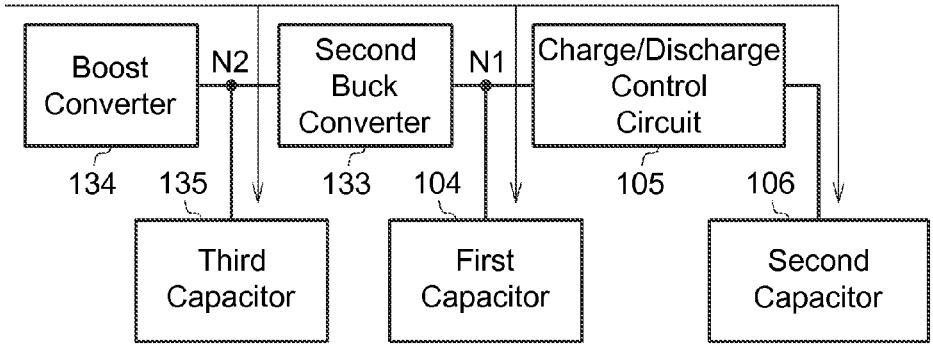
FIG. 7A shows the direction of the current charging the first, second, and third capacitors.
Figure 7B:
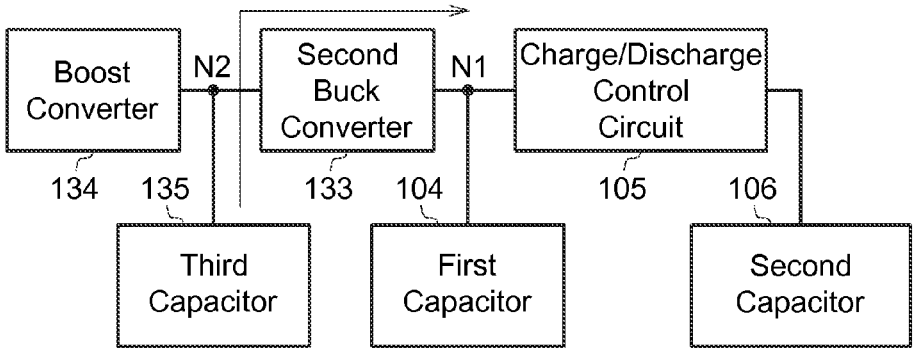
FIG. 7B shows the direction of the current discharging the third capacitor.
Figure 7C:
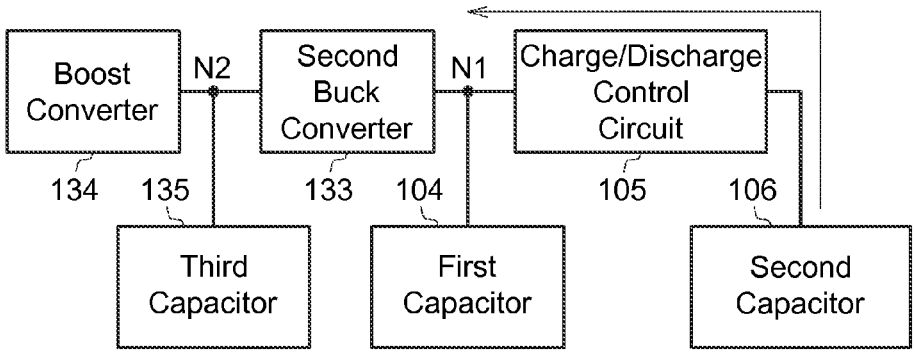
FIG. 7C shows the direction of the current discharging the second capacitor.

FIG. 7A shows the direction of the current charging the first, second, and third capacitors 104, 106, and 135. When the button 111 is not pressed, the first, second, and third capacitors 104, 106, and 135 are charged to predetermined voltage levels. For example, the first capacitor 104 is charged to 12V, the second capacitor 106 is charged to 23V, and the third capacitor 135 is charged to 70V. FIG. 7B shows the direction of the current discharging the third capacitor 135. FIG. 7B represents the first phase after the button 111 is pressed. Energy is provided by the charge stored in the third capacitor 135. The voltage level of the first voltage signal V1 is maintained by discharging the third capacitor 135. FIG. 7C shows the direction of the current discharging the second capacitor 106. FIG. 7C represents the second phase after the button 111 is pressed. The first capacitor 104 and third capacitor 135 supply the energy to hold the first voltage V1 constant after the button 111 is pressed. When the energy stored in the third capacitor 135 is insufficient, the charge/discharge control circuit 105 detects a voltage drop of the first voltage signal V1 and then controls the second capacitor 106 to be discharged to provide energy.

In this embodiment, because the doorbell device 4 includes three capacitors, charge is pre-stored in three separate locations, the first capacitor 104, the third capacitor 135 and the second capacitor 106. The time duration for power switching can thus be extended, which can further ensure that the internal circuit of the doorbell device 4 is not affected and the power supplied to the internal circuit can be maintained properly when the button 111 is pressed.

The voltage values in the embodiments described above are merely examples. The present invention is not limited to those voltage values. A person with ordinary skill in the art may be able to adjust the voltage values based on the real circuit design criteria.

In summary, because the doorbell device disclosed herein utilizes capacitors, power can be supplied to the internal control circuit of the doorbell device normally during the power switching duration caused by pressing the doorbell button. Furthermore, no battery is required in the doorbell device. Therefore charging circuit and/or boost converter accompanied with the battery is also not required. Circuit area can be reduced and production cost can thus be saved effectively. From a user's perspective, convenience is greatly enhanced since there is no need to replace batteries.

In addition, a versatile doorbell device with multiple functions is provided since the user interface of the doorbell device may further include an IP camera and/or an interphone. The power can be supplied to the control circuit even when the doorbell is pressed to guarantee continuous video recording. Moreover, the doorbell device disclosed herein can be connected to the AC power source directly. Thus the user does not have to modify the original indoor electrical wiring related to a doorbell. The doorbell device in the present disclosure can be installed easily.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A doorbell device, comprising:

a user interface, comprising a button;

a control circuit, coupled to the user interface, for generating a power control signal according to a state of the button;

a power switching circuit, coupled to the control circuit, for outputting a first voltage signal at a first node to supply power to the control circuit according to the power control signal;

a first capacitor, coupled to the first node;

a second capacitor; and a charge/discharge control circuit, coupled between the first node and the second capacitor, for controlling whether the second capacitor is charged or discharged according to the first voltage signal.

2. The doorbell device according to claim 1, wherein the user interface further comprises an IP camera.

3. The doorbell device according to claim 1, wherein when the first voltage signal is greater than or equal to a threshold voltage, the second capacitor is charged to a predetermined voltage; and when the first voltage signal is less than the threshold voltage, the second capacitor is discharged.

4. The doorbell device according to claim 1, wherein the power switching circuit comprises:

a switching device, comprising an input terminal coupled to a power supply signal, a control terminal coupled to the power control signal, and an output terminal;

a rectifier, coupled to the output terminal of the switching device; and a buck converter, coupled between the rectifier and the first node, for converting voltage outputted from the rectifier down to the first voltage signal at the first node.

5. The doorbell device according to claim 1, wherein the power switching circuit comprises:

a switching device, comprising an input terminal coupled to a power supply signal, a control terminal coupled to the power control signal, and an output terminal;

a rectifier, coupled to the output terminal of the switching device;

a boost converter, coupled to the rectifier, for converting voltage outputted from the rectifier up to a third voltage signal at a second node;

a third capacitor, coupled to the second node; and a buck converter, coupled between the rectifier and the first node, for converting voltage outputted from the rectifier down to the first voltage signal to the first node.

6. The doorbell device according to claim 5, wherein when the power supply signal is transmitted to the output terminal of the switching device, the third capacitor is charged; and when the power supply signal is not transmitted to the output terminal of the switching device, the third capacitor is discharged.

7. The doorbell device according to claim 1, wherein the doorbell device comprises no battery.

8. A doorbell device, comprising:

a user interface, comprising a button;

a control circuit, coupled to the user interface, for generating a power control signal according to a state of the button;

a power switching circuit, coupled to the control circuit, for outputting a first voltage signal at a first node according to the power control signal;

a first buck converter, coupled between the first node and the control circuit, for converting the first voltage signal down to a second voltage signal to supply power to the control circuit;

a first capacitor, coupled to the first node;

a second capacitor; and a charge/discharge control circuit, coupled between the first node and the second capacitor, for controlling whether the second capacitor is charged or discharged according to the first voltage signal.

9. The doorbell device according to claim 8, wherein the user interface further comprises an IP camera.

10. The doorbell device according to claim 8, wherein when the first voltage signal is greater than or equal to a threshold voltage, the second capacitor is charged to a predetermined voltage; and when the first voltage signal is less than the threshold voltage, the second capacitor is discharged.

11. The doorbell device according to claim 8, wherein the power switching circuit comprises:

a switching device, comprising an input terminal coupled to a power supply signal, a control terminal coupled to the power control signal, and an output terminal;

a rectifier, coupled to the output terminal of the switching device; and a second buck converter, coupled between the rectifier and the first node, for converting voltage outputted from the rectifier down to the first voltage signal at the first node.

12. The doorbell device according to claim 8, wherein the power switching circuit comprises:

a switching device, comprising an input terminal coupled to a power supply signal, a control terminal coupled to the power control signal, and an output terminal;

a rectifier, coupled to the output terminal of the switching device;

a boost converter, coupled to the rectifier, for converting voltage outputted from the rectifier up to a third voltage signal at a second node;

a third capacitor, coupled to the second node; and a second buck converter, coupled between the rectifier and the first node, for converting voltage outputted from the rectifier down to the first voltage signal to the first node.

13. The doorbell device according to claim 12, wherein when the power supply signal is transmitted to the output terminal of the switching device, the third capacitor is charged; and when the power supply signal is not transmitted to the output terminal of the switching device, the third capacitor is discharged.

14. The doorbell device according to claim 8, wherein the doorbell device comprises no battery.

* * * * *